US010297238B1

(12) United States Patent
Fugate

(10) Patent No.: US 10,297,238 B1
(45) Date of Patent: May 21, 2019

(54) RESONATOR CAP WITH INTEGRATED PLAYING SURFACE AND AMPLIFIER

(71) Applicant: Brett Fugate, Washington, IL (US)

(72) Inventor: Brett Fugate, Washington, IL (US)

( * ) Notice: Subject to any disclaimer, the term of this patent is extended or adjusted under 35 U.S.C. 154(b) by 0 days.

(21) Appl. No.: 16/130,645

(22) Filed: Sep. 13, 2018

Related U.S. Application Data

(60) Provisional application No. 62/558,834, filed on Sep. 14, 2017.

(51) Int. Cl.
*G10D 13/08* (2006.01)
*G10K 11/04* (2006.01)

(52) U.S. Cl.
CPC ..... *G10D 13/08* (2013.01); *G10K 11/04* (2013.01)

(58) Field of Classification Search
CPC ..... G10D 13/08
See application file for complete search history.

(56) References Cited

U.S. PATENT DOCUMENTS 1,104,478 A * 7/1914 Deagan ..... G10D 13/08 84/403
1,128,112 A * 2/1915 Deagan ..... G10D 13/08 84/410
1,173,783 A * 2/1916 Deagan ..... G10D 13/08 84/403
1,173,784 A * 2/1916 Deagan ..... G10D 13/08 84/403
1,173,785 A * 2/1916 Deagan ..... G10D 13/08 84/410
1,207,281 A * 12/1916 Deagan ..... G10D 13/08 84/410
1,595,359 A * 8/1926 Schluter ..... G10D 13/08 84/403
1,760,141 A * 5/1930 Jones ..... G10D 13/08 84/313
1,772,670 A * 8/1930 Liebich ..... G10D 13/08 84/410
1,935,566 A * 11/1933 Greenleaf ..... G10D 13/08 84/410
2,020,150 A * 11/1935 Ludwig ..... G10D 13/08 84/403
3,084,587 A * 4/1963 Baschet ..... G10D 13/08 181/160
3,138,986 A * 6/1964 Musser ..... G10D 13/08 84/403
3,174,382 A * 3/1965 Gugelot ..... G10D 13/08 84/404
3,673,909 A * 7/1972 Bimkrant ..... G10D 13/08 428/24
3,858,477 A * 1/1975 Kawakami ..... G10D 13/08 84/403
4,570,525 A * 2/1986 Suzuki ..... G10K 11/04 84/349
4,941,386 A 7/1990 Stevens
(Continued)

*Primary Examiner* — Robert W Horn
(74) *Attorney, Agent, or Firm* — Law Office of Lesley A. Wallerstein, LLC

(57) ABSTRACT

A cap for sealing the open end of a resonator tube in sonic communication with a bar percussion instrument tone bar. Not only does the resonator cap close the opening, but it provides an additional percussive playing surface and amplifies the sound produced when the tone bar is struck. This creates infinitely many new and additional sounds for this class of musical instrument.

6 Claims, 14 Drawing Sheets

(56) References Cited

U.S. PATENT DOCUMENTS

| | | | | |
|---|---|---|---|---|
| 5,189,236 | A | 2/1993 | Stevens | |
| 7,361,822 | B1 * | 4/2008 | Hsieh | G10D 13/08 84/402 |
| 8,389,841 | B1 | 3/2013 | Stevens | |
| 2019/0019487 | A1 * | 1/2019 | Inoue | G10K 1/07 |

* cited by examiner

RESONATOR CAP WITH INTEGRATED PLAYING SURFACE AND AMPLIFIER

CROSS-REFERENCE TO RELATED APPLICATION

This application claims priority to Provisional Application 62/558,834, filed Sep. 14, 2017

STATEMENT REGARDING FEDERALLY SPONSORED RESEARCH OR DEVELOPMENT

Not applicable

NAMES OF PARTIES TO A JOINT RESEARCH AGREEMENT

Not applicable

REFERENCE TO SEQUENCE LISTING, A TABLE OR A COMPUTER PROGRAM LISTING COMPACT DISC APPENDIX

Not applicable

FIELD OF THE INVENTION

This invention relates to an improved resonator cap for bar percussion instruments. The resonator cap contains a built-in playing surface and amplifier. This increases the quality of the sound and the quantity of different types of sounds this instrument can produce.

BACKGROUND OF THE INVENTION

Bar percussion instruments such as marimbas, xylophones, vibraphones and glockenspiels generate sound in two ways. They have a row or rows of tone bars supported on a frame. The tone bars comprise a solid material, including but not limited to wood, metal, fiberglass, graphite or composites of these. Hanging beneath and in sonic communication with the tone bars are corresponding rows of hollow tubular resonators. When a musician batters a tone bar, that mechanical energy is transferred to air in the resonator, creating a standing wave, and an audible tone. The resonator amplifies and concentrates the fundamental frequency generated by the tone bar.

Each resonator tube has a proximal end nearest the tone bars, and an opposing distal end. Sometimes the distal end points toward the floor and sometimes it points toward the ceiling, or toward the player, or to a left or right side. The proximal end is open and hangs just beneath, but does not touch, its corresponding tone bar. The distal end is closed, capped or plugged, defining a length. This length is important, as it determines the frequency of the sound it generates when its tone bar is struck. When a tone bar is struck, it generates a standing wave that passes through the resonator tube. When the tone bar and its resonator tube are in tune, they produce a strong, clear and rich note. This is called the fundamental tone. To achieve the fundamental tone, resonator tubes must each be cut to precise lengths. Instrument manufacturers use a precise mathematical formula to determine the length of the tubes. For example, the length of a tube necessary to generate middle C is equal to $$\text{length}=c/4v$$

where c is the speed of sound in m/s and v is the frequency in Hertz. For air, c=343 m/s. For middle C, v=262 Hz. Therefore, to make a resonator for the middle C key, the tube should be cut to:

$$343/(4)(262)=0.327 \text{ m or } 32.7 \text{ cm}$$

The manufacturer then closes, caps or plugs the tube at the distal end. This ensures that this standing wave is the correct frequency. Some manufacturers permanently cap the tube at the prescribed length. Others sell open tubes, with separate caps that the musician can insert into the distal end and lock into place. The separate cap has the advantage of letting the musician adjust the effective length of the resonator tube, and therefore its frequency.

Most prior art resonator caps or plugs are made from metal or plastic. Plugs function exactly like what the name implies. They are a slightly smaller diameter than an inner diameter of the tube and can be inserted into the open distal end of the resonator tube, then expanded in place using internal circular leaf springs, radial cutouts in the plug itself, foam rubber and/or mating threads. Resonator plugs are commonly solid metal, or a tube of metal within a tube of metal. In addition to the metal, the plugs may also contain a layer of foam, or a filter, to muffle certain overtones produced by the tone bars and to enhance the overall fundamental tones of the instrument. Expanding the plug in this way creates a seal which traps the column of air within the tube at the desired length.

Another justification for having insertable plugs sold separately is that they make it easy for the musician to compensate for changes in ambient temperature and humidity. It is true that in general, temperature affects how musical instruments sound. Warmer air causes wood and metal to expand, decreasing pitch. Cooler air causes wood and metal to contract. The reader should keep in mind that tone bars are solid wood or metal. Resonator tubes are hollow wood or metal. Decreasing the temperature causes both the bar and the walls of the tube to contract. This is true for both metal and wood. When the walls of the tube contract, the space within the tube increases. When the tone bar contracts, it produces a higher or sharper pitch sound. At the same time, the walls of the resonator tube also contract. More space inside the tube actually creates a lower or flatter pitch sound.

One skilled in the art would know that while the weather does affect each part of the instrument, the net effect is that the instrument remains in tune. The contraction or expansion of the various parts stays in proportion. Experience has shown that there is no measurable benefit from having a separate part to tune the resonator, at least not due to air temperature. The temperature does affect the instrument, but only negligibly. Manufacturers of these caps try to sell musicians on the ability of the caps to compensate for short term changes in temperature when in fact this does not measurably affect tuning.

The most significant cause of tone bars and tubes growing out of tune is wear and tear on the tone bars. Over time, the constant battering, setting up and taking down the instrument chips away, cracks, dents, scrapes and damages the wood or metal. A bar which has lost mass or is deformed will sound differently than it once did. Frequent changes in temperature can also permanently change the quality of the wood or metal. Repeatedly battering the bar with a mallet can also heat up the bar and cause it to temporarily expand. It then cools down. These constantly alternating temperatures have long-term effects on tuning. These variables affect the tuning much more so than temporary and small changes in ambient temperature. My resonator cap is detachable and can be tuned to a tone bar simply by tightening or loosening the cap against the bearing edge of the resonator.

Other prior art resonator caps have different problems. Marimba resonators produced in Mexico and other Central American countries have a membrane attached to small holes at the distal end of the tube. Usually this membrane is some sort of intestine skin and is often adhered to the tube with glue or wax. This creates a permanent buzzing effect that a musician may or may not want. This membrane style cap is thin and prone to damage.

My integrated resonator cap solves these, and other, problems. It requires no separate parts and is fully tunable. A flexible, yet durable, percussive playing surface seals the distal end of the resonator tube. The cap is crafted from a membrane that is so strong that it can be battered like a drum. This is like having a whole other instrument to play. Optionally, secured against this membrane is an amplifying tube. In a preferred embodiment, the amplifying tube is a cone. Other shapes of amplifying tubes are possible and within the scope of this invention. These other shapes include but are not limited to cylinders, coils and prisms. When a musician strikes a tone bar, this creates a sound wave. The wave travels through the resonator tube. The energy from the wave vibrates the membrane and transfers the energy to the cone, amplifying the sound wave beyond what the resonator tube would do alone. The cone is secured to the membrane so that even if the cap is turned upside down, the cone remains held against the membrane.

I am not aware of any marimbas, xylophones or other bar percussion instruments that have a flexible membrane which simultaneously creates a percussive playing surface and a platform for an amplifier, and further, tunes the resonator. My system allows a musician to manipulate the resonator's sound in ways that were not possible before. Musicians can use this system as a traditional resonator tube, an amplified resonator tube with a new fundamental tone, as an independent, miniature drum, or as a combined resonator and mini-drum. My invention creates infinitely many new creative playing, performing and composing options for this class of instruments.

REFERENCE NUMERALS

Figure 1:
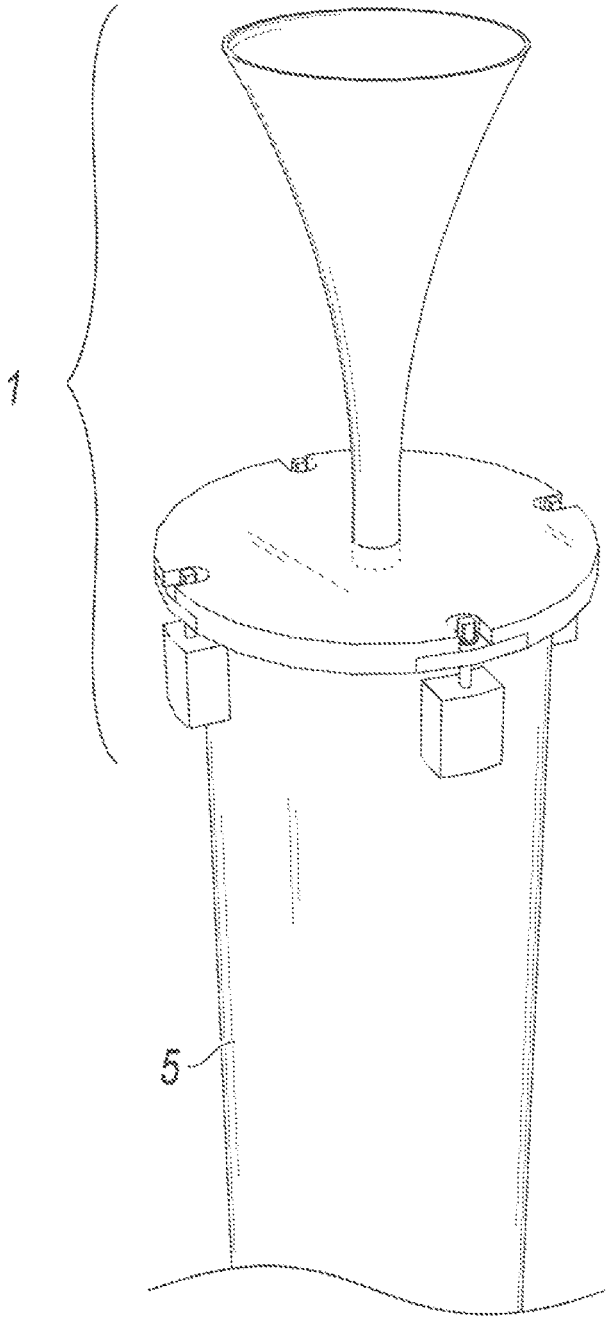
FIG. 1 is a close, perspective view of an assembled resonator cap with integrated playing surface and amplifier, installed on a distal end of a resonator tube.

1. Resonator cap with integrated playing surface and amplifier
5. Resonator tube
10. Amplifying cone
15. Clamp
20. Cone-retaining hole
25. Hoop
30. Lug
35. Tension rod
40. Membrane
45. Tab
50. Groove
55. Bearing edge

DETAILED DESCRIPTION OF THE INVENTION

Figure 2A:
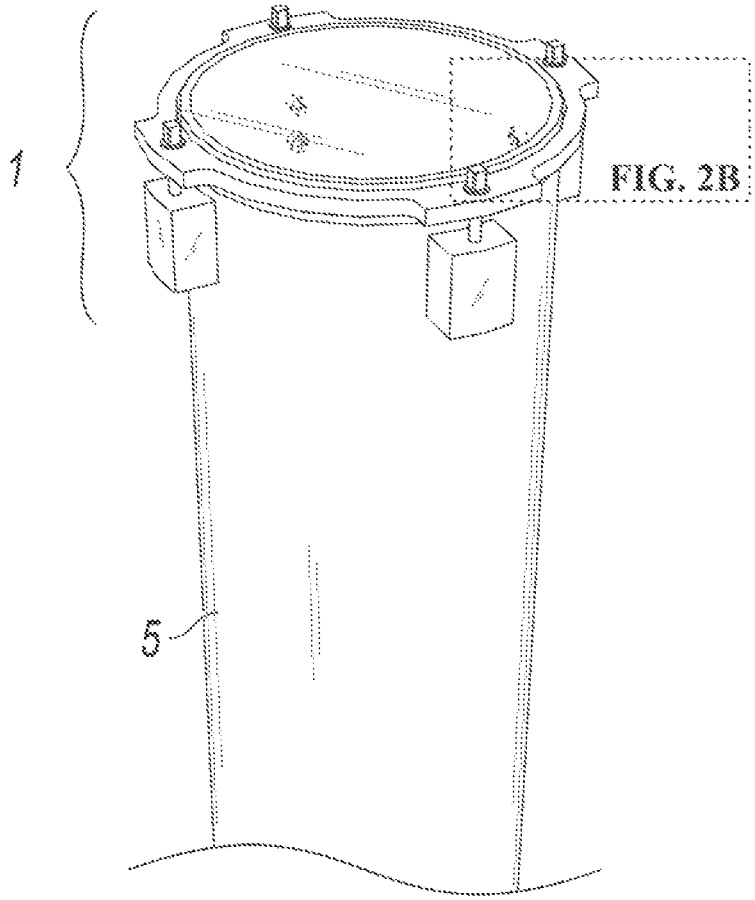
FIG. 2A is a perspective view of the resonator cap of FIG. 1, installed on a distal end of a resonator tube, without its amplifying cone.
Figure 2B:
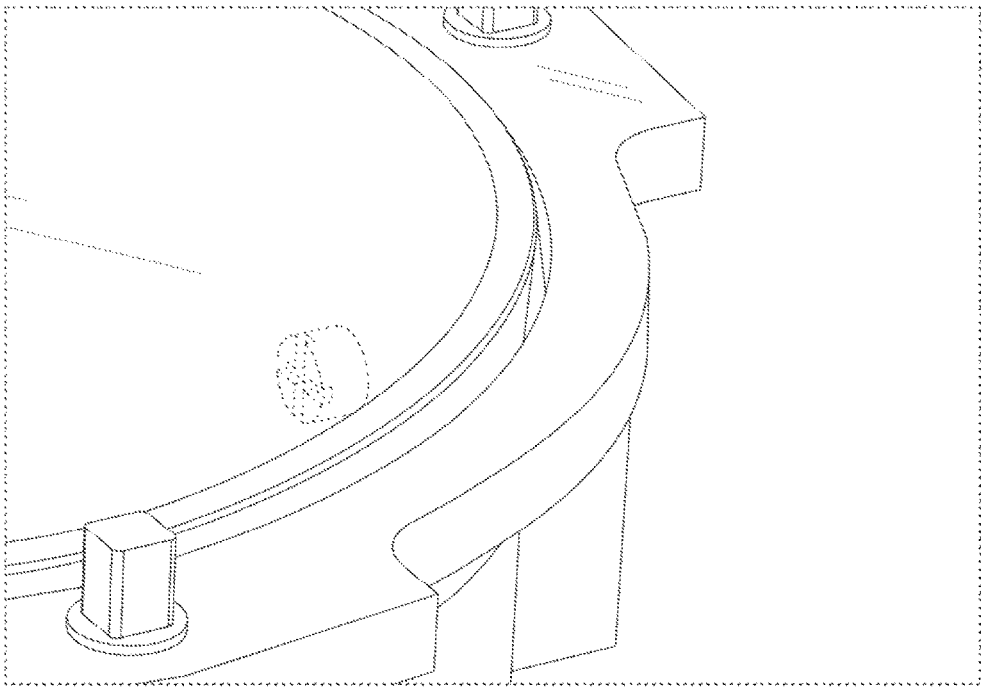
FIG. 2B is a close, perspective view of the resonator cap of FIG. 1, installed on a distal end of a resonator tube, without its amplifying cone.

FIG. 1 is a close-up perspective view of an assembled resonator cap with integrated playing surface and amplifying cone 1, installed against a bearing edge (not shown in this view) of an open distal end of a representative resonator tube 5. FIG. 2A shows resonator cap 1 installed without the amplifying cone. Resonator tubes are typically hollow circular cylinders 3 inches in diameter, but this is highly variable. Common materials are aluminum, steel, brass and PVC, but other materials and other cross-sectional geometries, such as ovals, may be used and fall within the scope of this invention. The cap is substantially the same diameter and cross section as the tube, so that it encloses the opening at the distal end of the tube. No air should leak through the cap. The diameter of the resonator tube, and its corresponding cap, can be adjusted as is known to those of ordinary skill in the art. For purposes of simplicity and clarity, I illustrate caps on one or two resonator tubes. That said, my caps can be used to cover as many of the resonator tubes in a complete instrument as the musician wants.

Figure 3:
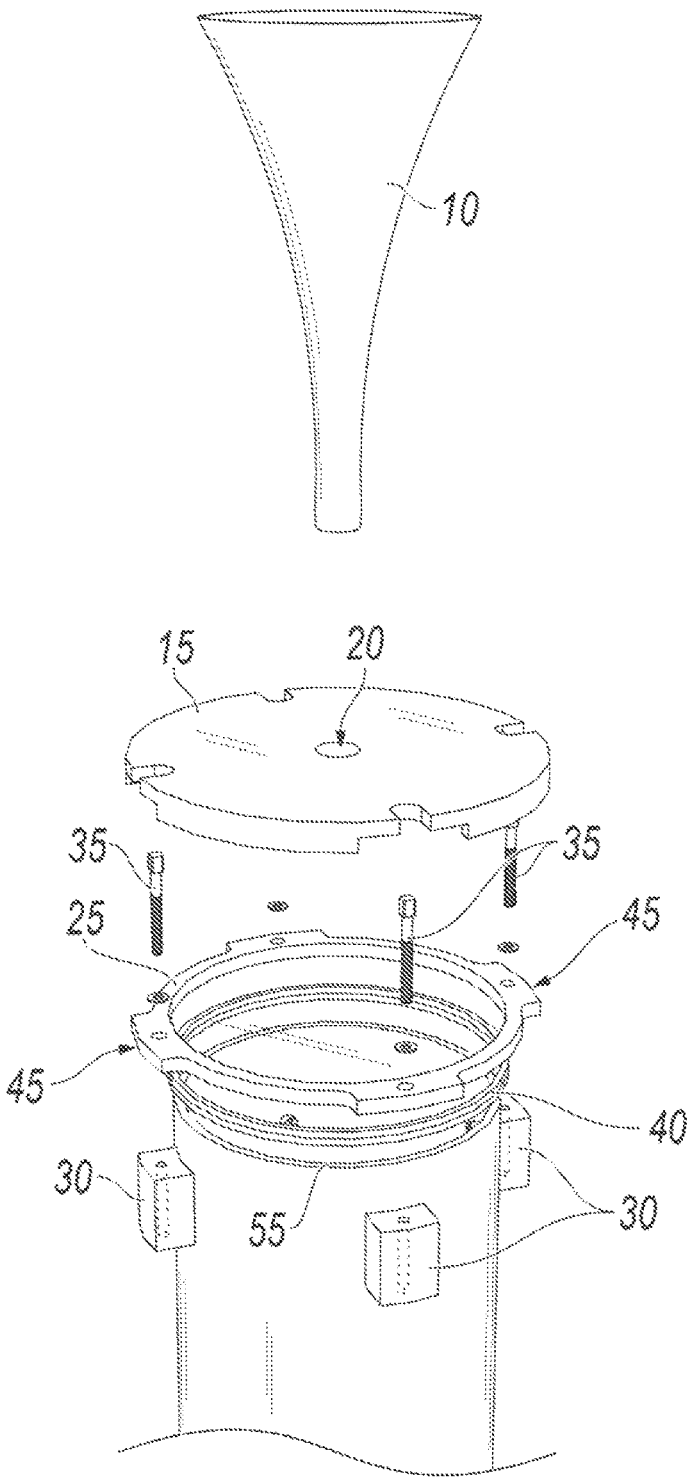
FIG. 3 is an exploded view of the resonator cap of FIG. 1.
Figure 4:
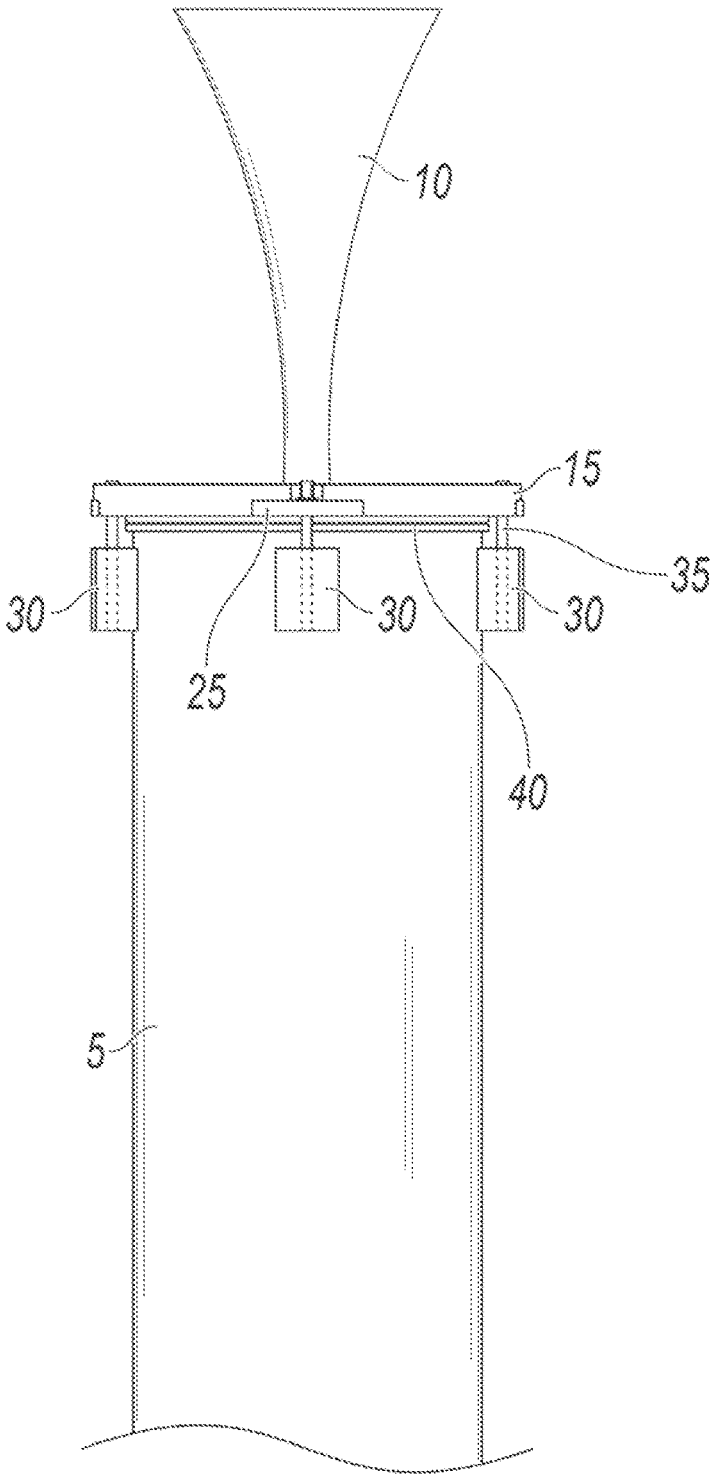
FIG. 4 is a front view of the resonator cap of FIG. 1.
Figure 5:
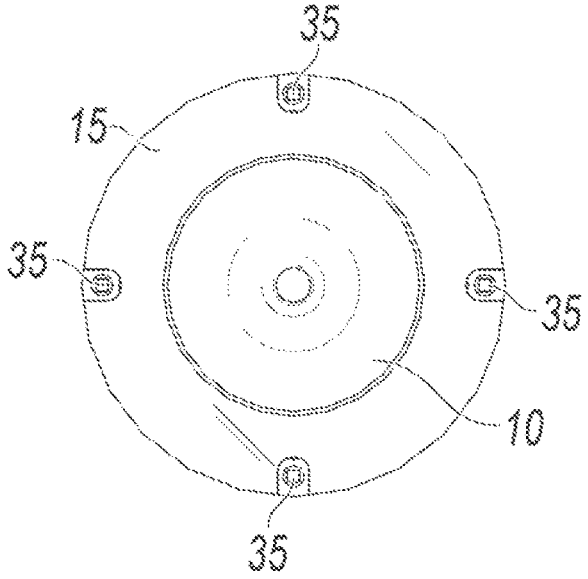
FIG. 5 is a top view of the resonator cap of FIG. 1.

FIG. 3 shows in detail the components of the cap and how they attach to the distal end of a typical resonator tube. Lugs 30 are affixed equidistant from one another around an outer surface of the tube. Lugs 30 are affixed the same distance from the bearing edge of the distal end of the resonator tube. In this example, I use four lugs, spaced at 12 o'clock, 3 o'clock, 6 o'clock and 9 o'clock. Preferably, I permanently affix the lugs to the resonator tube by fasteners such as screws. I also contemplate using other methods of permanent attachment known to those of ordinary skill in the art, including but not limited to, rivets, solder, welding, brazing, or adhesive. Each lug 30 has an internally threaded longitudinal hole running the length of and passing through the lug. This threading is dimensioned to accept and mate with corresponding externally threaded tension rods 35. Lugs 30 are oriented on the resonator tube so that the threaded holes are parallel to the length of the resonator tube.

Membrane 40 comprises a sheet of synthetic or natural material stretched taut within a rigid rim. Synthetic materials include, but are not limited to, polyesters such as Mylar®, or aramids such as Kevlar®. Natural materials include, but are not limited to, animal skins. The membrane in its rim has a perimeter and a shape dimensioned to be congruent with, and seal, the bearing edge of the distal end of the resonator tube. In the example shown, the resonator tube is circular, but other geometric shapes are possible and within the scope of this invention. All shapes have a perimeter.

Figure 15:
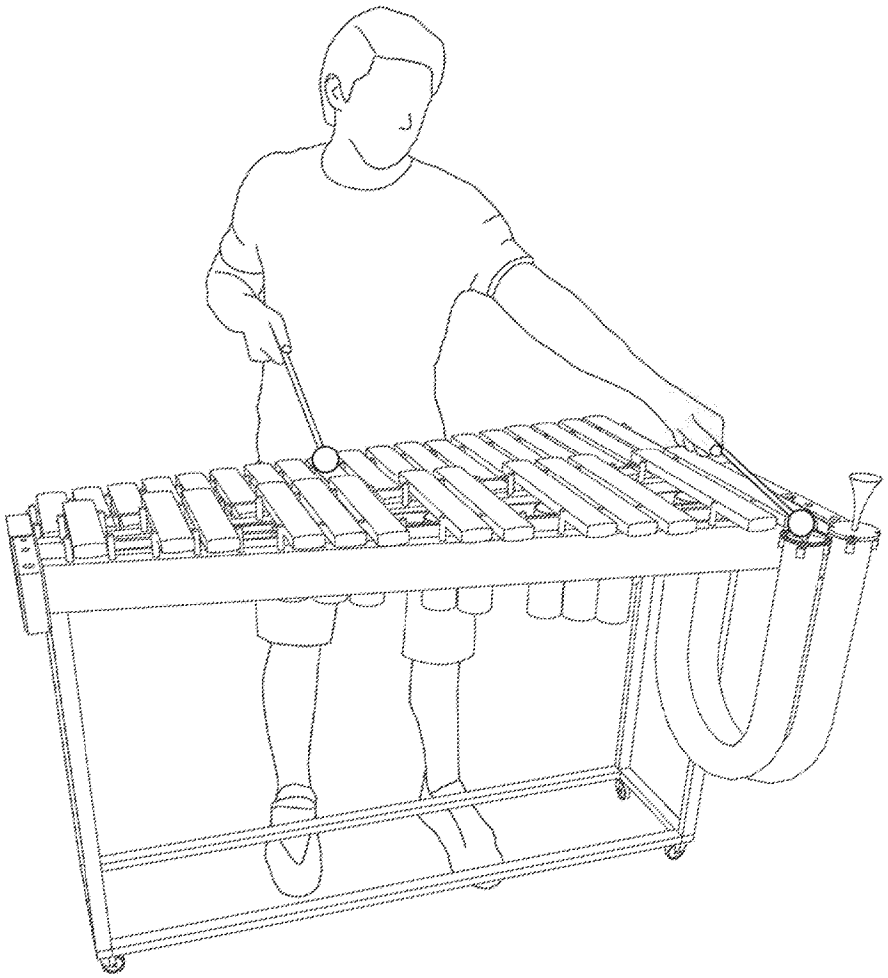
FIG. 15 is a perspective view of a musician simultaneously striking a tone bar and the membrane of the resonator cap.

Hoop 25 has a perimeter and a shape which is also congruent with, and seals closed, the open distal end of the resonator tube and the membrane. The hoop has a geometric center, and a plurality of perimeter tabs 45 projecting away from the center. There is a tab corresponding to each lug. Each tab 45 has a hole. This hole vertically aligns with the hole in the lug. Each tension rod 35 has a head (not numbered) which is dimensioned larger than the tab hole, and an externally threaded body dimensioned smaller than the tab hole but which mates with the internal threads in its corresponding lug. To seal closed the open distal end of the resonator tube, a musician first lays membrane 40 across the opening. He then lays hoop 25 over the membrane, sandwiching the membrane therebetween and aligning the holes in the hoop directly over each corresponding hole in the lug. All hoop holes line up with exactly one lug hole. The musician next drives a tension rod through the hoop hole and into the lug hole. The tension rod does not intersect the membrane because the tab holes and lug holes radially project beyond the perimeter of the membrane. He engages the threads in the lug hole and drives the rod further into the hole. He can do this using a tool such as a drum key or other driving means known to those of ordinary skill in the art. Tightening each tension rod tightens membrane 40 against bearing edge 55 of the resonator tube. Secured in this way, the musician can strike membrane 40 like a drum, as shown in FIG. 15. He may beat this mini-drum alone, or together with a tone bar. This same membrane doubles as a platform for collecting and transmitting sound wave energy traveling through the resonator tube.

The remaining components in FIG. 3 are directed to the amplifying function of the invention. Please note hollow cone 10. It has an open wide end and an open narrow end. The distal segment of an existing musical instrument may serve as a convenient cone. The musical instrument includes, but is not limited to, a woodwind instrument such as clarinet or a brass instrument such as a French horn and trumpet. The cone need not be taken from an existing musical instrument. Musicians may create their own cone from any hollow and rigid tube and having any curvature, as long as it has a distinct wide end and a distinct narrow end.

Figure 6:
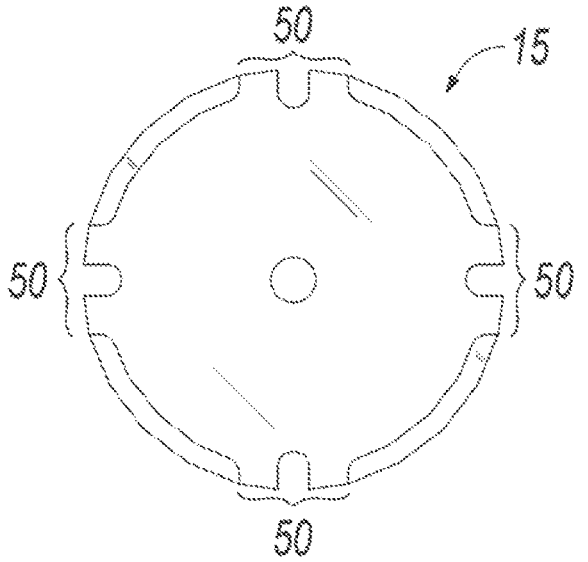
FIG. 6 is a bottom view of the clamp.
Figure 7:
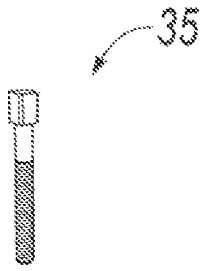
FIG. 7 is a perspective view of the tension rod.
Figure 8:
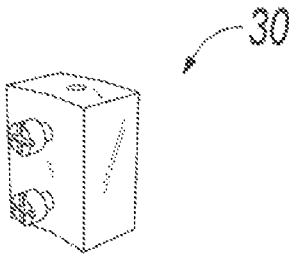
FIG. 8 is a perspective view of the lug.
Figure 9:
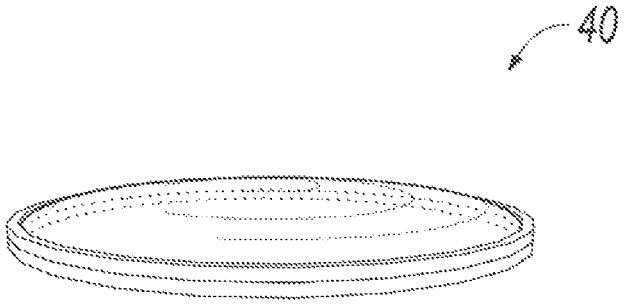
FIG. 9 is a perspective view of the membrane.
Figure 10:
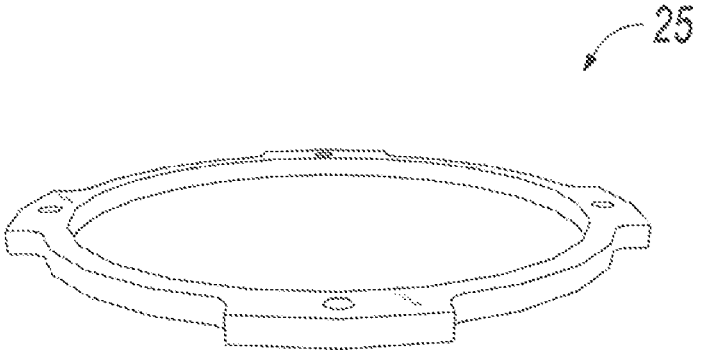
FIG. 10 is a perspective view of the hoop.
Figure 11:
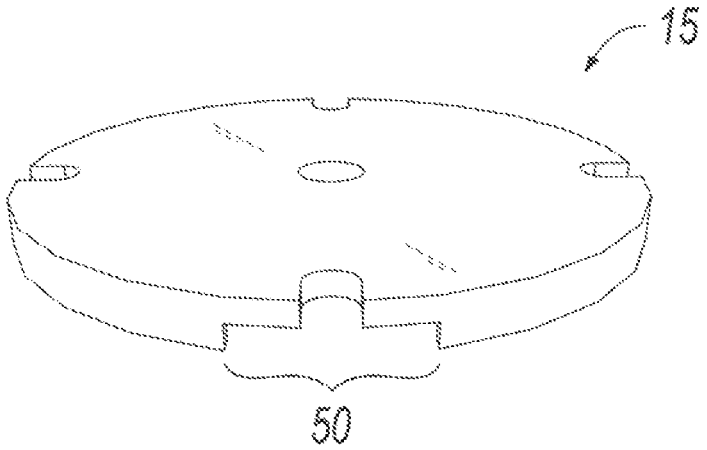
FIG. 11 is a top perspective view of the clamp.
Figure 12:
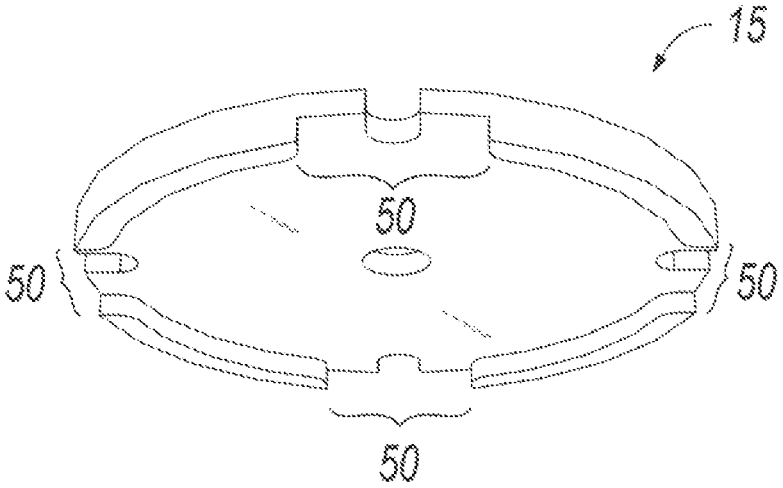
FIG. 12 is a bottom perspective view of the clamp.

This narrow end rests on membrane 40 and picks up sound wave energy collected from inside the resonator tube. The wave is transmitted through the body of the cone and amplified to the environment. Clamp 15 comprises a planar surface of solid material dimensioned to completely cover and mate with hoop 25. Preferably, clamp 15 is wood, metal or plastic, but any solid and rigid material will work. The planar surface has a thickness and a perimeter with a lip (not numbered) depending perpendicularly from the perimeter. A plurality of grooves 50 corresponding to the number and position of hoop tabs and lugs is cut into the lip. These grooves are dimensioned to press fit into their corresponding tabs on the hoop while also leaving the hoop holes exposed. Please refer to FIGS. 6, 11 and 12.

Clamp 15 further comprises a central hole cut through its thickness. The hole is specifically dimensioned to accept and to retain by press fit the open narrow end of cone 10. Clamp 15 holds cone 10 directly against membrane 40. Please see FIG. 1. When a wave of sound hits membrane 40, the membrane transmits that energy directly and efficiently to the cone. The shape of the cone amplifies that wave to the air, where it may be heard.

Figure 13A:
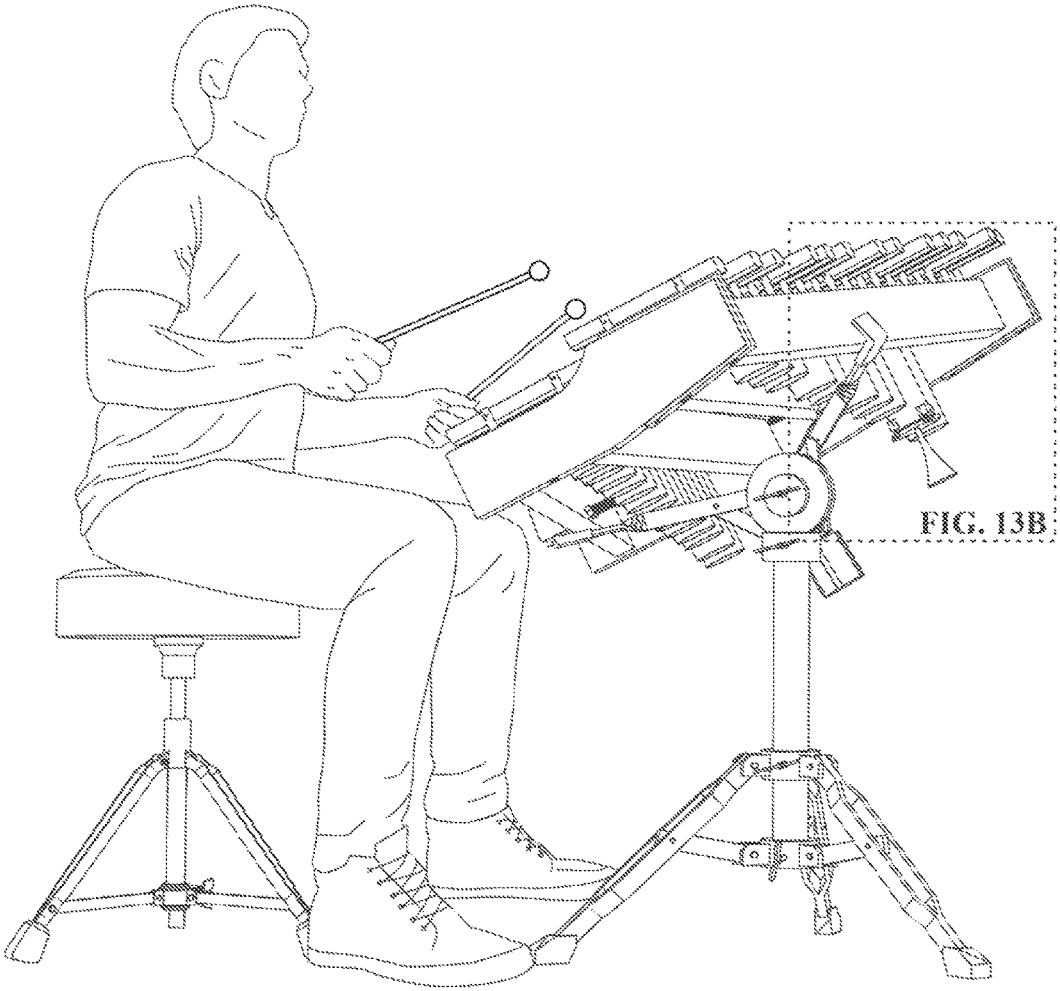
FIG. 13A is a perspective view of a musician playing a first bar percussion instrument fitted with the resonator cap and amplifying cone.
Figure 13B:
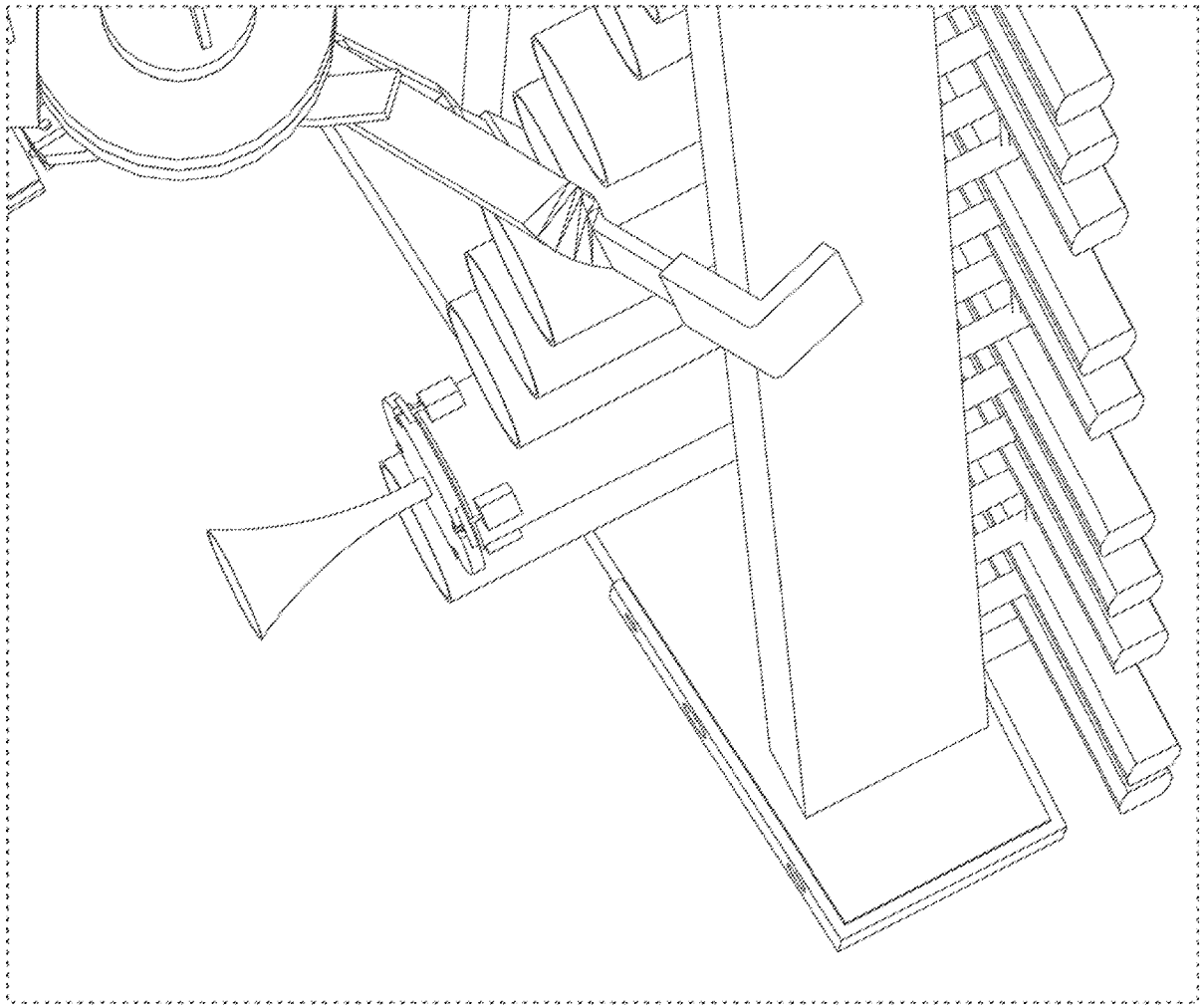
FIG. 13B is a close perspective view of a musician playing the first bar percussion instrument fitted with the resonator cap and amplifying cone.
Figure 14A:
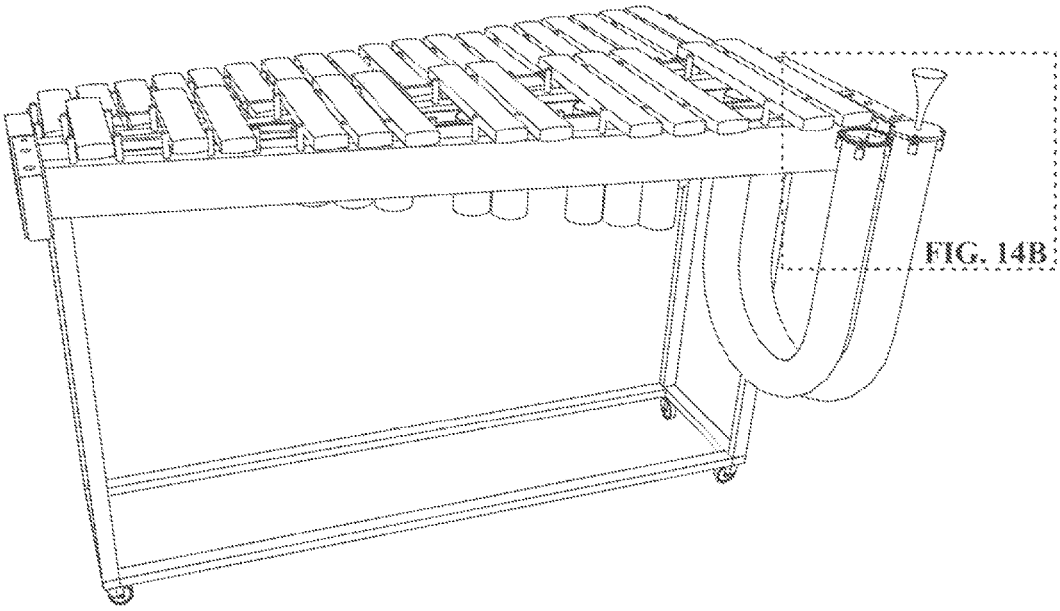
FIG. 14A is a perspective view of a second bar percussion instrument fitted with the resonator cap, both with and without its amplifying cone.
Figure 14B:
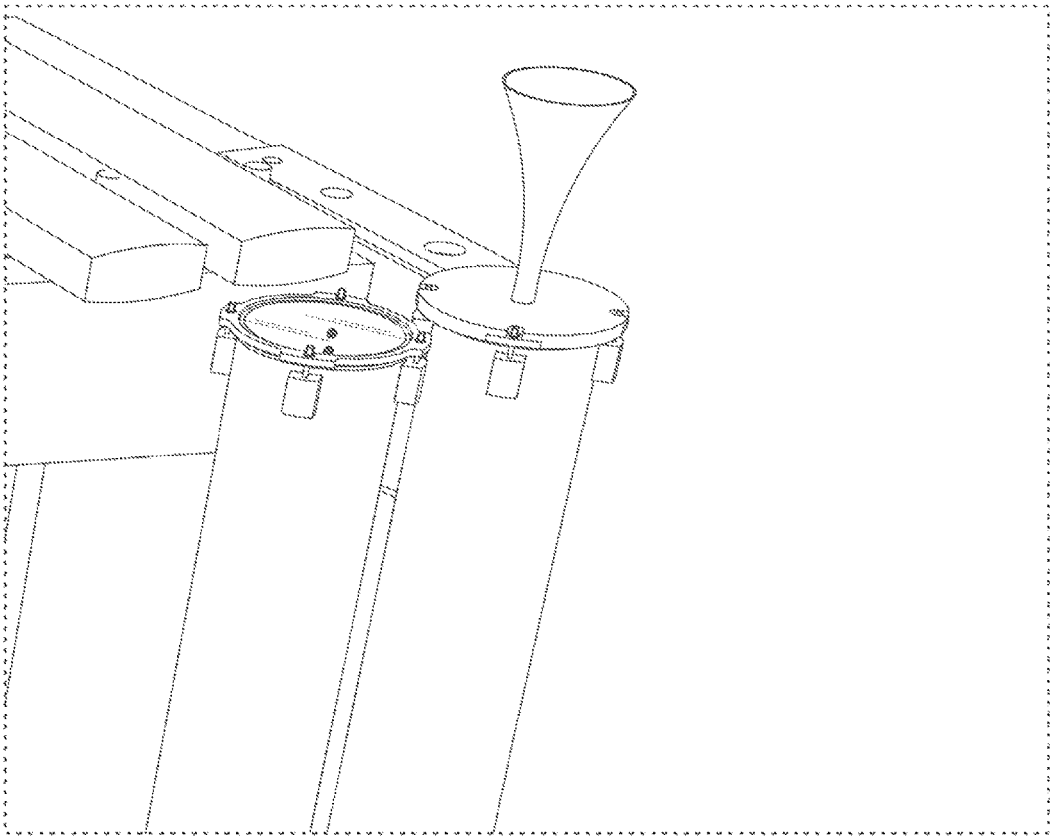
FIG. 14B is a close perspective view of the second bar percussion instrument fitted with the resonator cap, both with and without its amplifying cone.

The cap may be installed on resonator tubes generally facing the floor, as in the xylophone of FIGS. 13A and 13B. Because the cone is closely press fit into the clamp, which is in turn closely press fit into the hoop, the cone will not fall due to gravity or downward force. The resonator cap may also be attached to tubes facing away from the floor, or in other directions, as in the marimba of FIGS. 14A, 14B and 15 or other bar percussion instruments. Even with the cap facing away from the floor, the press fit of the hoop, cone and clamp still secure the cone during play.

I claim:

1. A resonator cap, comprising:

a. a resonator tube having an open proximal end in sonic communication with a percussion instrument tone bar, and an open distal end, the open distal end having a bearing edge;

b. a percussive playing surface dimensioned to cover the open distal end of the resonator tube;

c. a rigid hoop holding taut the percussive playing surface and retaining the percussive playing surface against the bearing edge, this hoop having a perimeter;

d. means for selectively tightening the hoop and percussive playing surface against the bearing edge of the resonator tube, thereby closing the open distal end of the resonator;

e. an amplifying cone having an open narrow end in sonic communication with the percussive playing surface, and an opposing open wide end; and f. a clamp selectively securing the open narrow end of the amplifying cone against the percussive playing surface.

2. The resonator cap of claim 1, wherein the selective tightening means comprises:

a. a plurality of holes drilled equidistant from one another and along the perimeter of the hoop;

b. a corresponding plurality of internally threaded lugs affixed equidistant from one another, around an outer surface of the distal end of the resonator tube;

c. a corresponding plurality of tension rods, each such tension rod having a head dimensioned larger than a corresponding hole in the hoop, and an externally threaded body dimensioned smaller than a corresponding hole in the hoop and dimensioned to mate with the threads of its corresponding lug; and d. a tool dimensioned to selectively drive each tension rod into and out from its corresponding lug.

3. The resonator cap of claim 2, wherein the clamp press fits into the hoop and further comprises a central hole dimensioned to retain by press fit the narrow end of the amplifying cone.

4. The resonator cap of claim 3, wherein the amplifying cone is selected from the group consisting of woodwind instrument cone and brass instrument cone.

5. A method of amplifying a bar percussion instrument tone bar in sonic communication with an open proximal end of a resonator tube, comprising the steps of:

a. affixing and tightening a percussive playing surface against a bearing edge of an open distal end of the resonator tube, thereby closing the open distal end;

b. clamping a narrow end of an amplifying cone against the percussive playing surface; and c. striking the bar percussion instrument tone bar.

6. A method of creating a fundamental tone of a resonator tube in sonic communication with a bar percussion instrument tone bar, comprising the steps of:

a. affixing and tightening a percussive playing surface against a bearing edge of an open distal end of the resonator tube, thereby closing the open distal end;

b. striking the percussive playing surface.

* * * * *